United States Patent [19]

Estavoyer et al.

[11] Patent Number: 4,946,756

[45] Date of Patent: Aug. 7, 1990

[54] METHOD FOR FIXING A POWDERED DEVELOPER DEPOSITED ON A SHEET, AND APPARATUS FOR FIXING THE DEVELOPER BY THIS METHOD

[75] Inventors: Jacques Estavoyer, par Bavilliers; Pascal Faivre, Valdoie, both of France

[73] Assignee: Bull S.A., Paris, France

[21] Appl. No.: 266,676

[22] Filed: Nov. 3, 1988

[30] Foreign Application Priority Data

Nov. 4, 1987 [FR] France ..... 87 15309

[51] Int. Cl.[5] ..... G03G 13/20

[52] U.S. Cl. ..... 430/124; 219/216; 432/229; 432/230; 355/286

[58] Field of Search ..... 430/124; 219/216; 432/229, 230; 355/286

[56] References Cited

U.S. PATENT DOCUMENTS 3,481,589 12/1969 Cely et al. .

4,034,186 7/1977 Bestenreiner et al. ..... 219/216

4,140,894 2/1979 Katakura et al. ..... 219/216 X 4,161,644 7/1979 Yanagawa et al. ..... 219/216

4,386,840 6/1983 Garthwaite et al. ..... 430/124 X

*Primary Examiner*—Roland E. Martin

*Attorney, Agent, or Firm*—Kerkam, Stowell, Kondracki, & Clarke

[57] ABSTRACT

The invention relates to a method and an apparatus with which a powdered developer deposited onto a sheet of paper can be fixed. The method comprises moving the sheet in such a manner that its leading edge (BV) comes to face a source (47) integral with a movable support, initially placed in a position of repose, and then, after immobilization of the sheet, displacing the support over a distance (N) less than the length (L) of the sheet, and moving the support to the position of repose while simultaneously displacing the sheet in the same direction, at a speed greater than the speed of the support. The invention is applicable to magnetic printing machines.

4 Claims, 4 Drawing Sheets

METHOD FOR FIXING A POWDERED DEVELOPER DEPOSITED ON A SHEET, AND APPARATUS FOR FIXING THE DEVELOPER BY THIS METHOD

FIELD OF THE INVENTION

The present invention relates to a method for fixing a powdered developer deposited on a sheet.

Such a method is used more particularly, but not exclusively, in electrostatic or magnetographic printers, in which individual sheets of paper, after having been coated with a powdered developer product transferred from a recording carrier, are fed one by one past a fixation apparatus intended to effect the instantaneous fusion of the developer and thus to permit it to be definitively fixed onto the sheets.

The present invention also relates to a fixation apparatus in which this method is used.

BACKGROUND OF THE INVENTION

In modern equipment used for information processing, high-speed printers in which character printing is achieved without the impact of printing type in relief on a receiving sheet of paper are increasingly being used. These printers, known as non-impact printers, include a recording element, most frequently comprising a rotary drum or endless belt, on the surface of which sensitized zones, also known as latent images, that correspond to the characters or images to be printed can be formed either electrostatically or magnetically. The latent images are then developed, or in other words made visible, with the aid of a powdered developer which when deposited on the recording element is attracted only by the sensitized zones thereof, thus forming an image in powder on the surface of the element. After that, the recording element is put into contact with a sheet of paper in order to allow the developer particles comprising the powdered image to be transferred onto the sheet and be definitively fixed there.

Such printers, when they are sheet-fed, are capable of printing the sheets of paper on one side at a relatively high printing speed; the printing speed may be as high as 10 pages a minute, or even more, by way of example. As a result, the quantity of paper that is printed by these machines in a given period of time is relatively high by comparison with what is printed during the same period of time by impact printers.

In order to reduce the volume of paper printed by these high-printing-speed machines, machines have been developed that are capable of printing each sheet of paper on both sides. Such machines include that described in French Patent No. 2.119.656 (corresponding to U.S. Pat. No. 3,697,171), in which in order to permit printing both sides of a sheet, a first powdered image is formed on the recording element and then transferred to an intermediate element, and then a second powdered image is formed on the recording element, and finally this recording element and the intermediate element are applied to both sides of the sheet, to bring about the simultaneous transfer of the two images to the two sides.

However, since the second powdered image cannot be formed on the recording element until after the first powdered image has been transferred to the intermediate element, the time necessary for formation of these two images and for their simultaneous transfer to the two sides of one sheet is virtually double what would be necessary to form a single powdered image on the recording element and to transfer this single image to one of the sides of the sheet.

As a consequence, in order to allow sufficient time for formation of each of the first powdered images on the recording element and the transfer of each image to the intermediate element, the sheets to be printed, which are fed continuously so as to pass between the recording element in the intermediate element, must follow one another at such intervals that any two successive sheets will be separated from one another by a distance equal to at least the length of one sheet.

Moreover, since these sheets are driven at high speed, in order to guarantee a relatively high printing speed, the fixation apparatus that passes across each sheet after the sheet has received the powdered images on both sides must be equipped with a sufficiently powerful heating element to bring about the fusion of the particles of developer covering the sheet during the brief passage of the sheet through this apparatus. Considering the high speed at which the sheets are driven, it is accordingly necessary to provide either a powerful heating element to bring about this fusion, or a heating element of moderate power but of sufficiently length that, by increasing the duration of the passage of each sheet through the fixation apparatus, the same effects can be obtained as those produced with a very powerful heating element. However, the use of a very powerful heating element has the disadvantage of generating major heat, which is prejudicial to good functioning of the machine, while the use of a heating element of moderate power but great length has the disadvantage of considerably increasing the size of the machine.

OBJECT AND SUMMARY OF THE INVENTION

The present invention overcomes these disadvantages and proposes a method that allows the developer particles deposited on the sheets, which are fed at high speed, to be definitively fixed on the sheets while using only a relatively short heating element of moderate power for this fixation.

More precisely, the present invention relates to a method for fixing a powdered developer deposited on one of the sides of the printing sheet, comprising subjecting this side to the action of a radiation capable of bringing about the instantaneous fusion of the developer, this method being characterized in that it comprises, first, arranging the sheet such that a first edge of the sheet is located facing a source of radiation that is temporarily immobilized in a position of repose, and then performing two successive phases, one of which comprises holding the sheet immobile and displacing the source before the sheet, at a first constant speed, along a direction perpendicular to this edge, but over a length less than the distance that separates this edge from a second edge opposed to the first edge, and then the other phase comprises displacing this source in the reverse direction and simultaneously displacing the sheet in the same direction as the source and at a constant speed greater than said first speed, the movement of the source, in the course of this second phase, taking place at a second speed the value of which is numerically equal to the speed of displacement of the sheet, minus the value of the first speed.

The invention will be better understood and further objects and advantages will become more apparent from the ensuing detailed described, given by way of non-limiting example, taken in conjunction with the drawings.

DESCRIPTION OF THE PREFERRED EMBODIMENT

Figure 1:
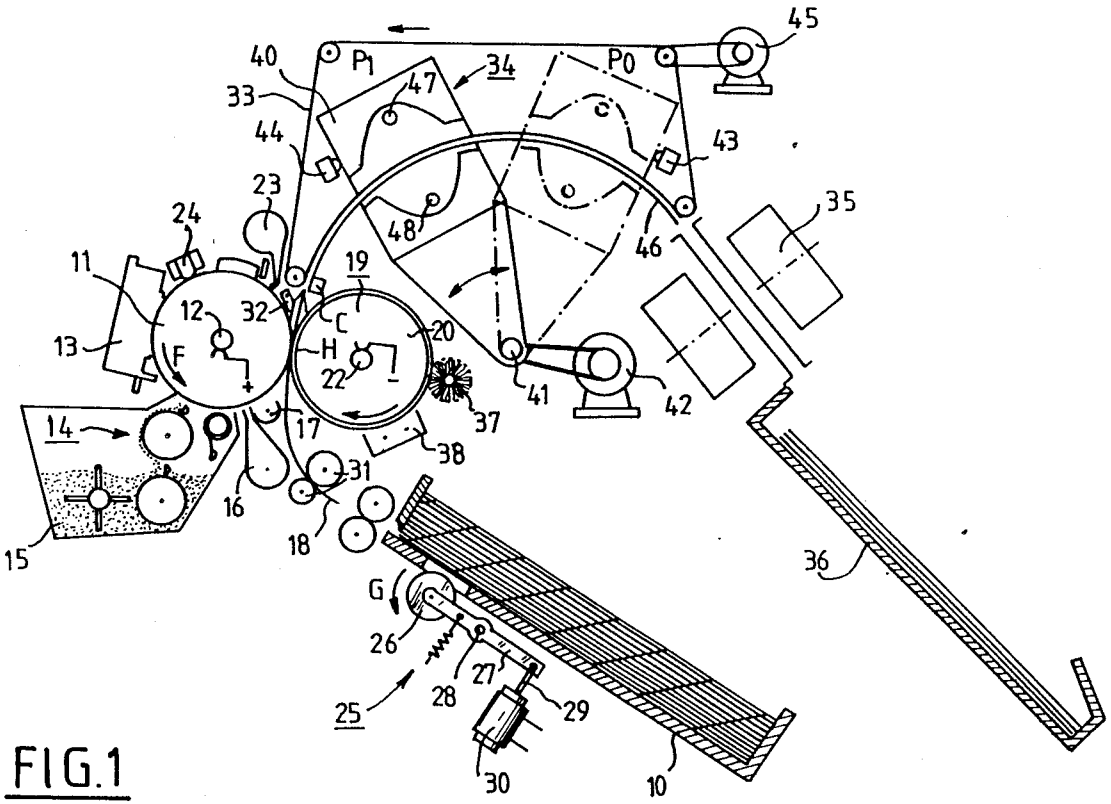
FIG. 1 shows a magnetographic printer equipped with a fixation apparatus according to the invention.

The structure and function of the fixation apparatus with which the printer shown in FIG. 1 is equipped depend on the manner in which the sheets of paper are fed into this machine for printing. Accordingly, before the fixation apparatus is described, some details relating to the constitution of this printer will be provided.

The printer that is schematically shown in FIG. 1 is a printer that performs printing of sheets of paper drawn in succession from a feed magazine 10. The printer includes a recording element, which in the example described comprises a magnetic drum 11. The drum 11, which is mounted so as to be capable of rotating about a horizontal shaft 12, is driven in rotation in the direction indicated by the arrow F, by an electric motor (not shown). The recording of the information on this drum is performed by a recording device 13 that includes a plurality of magnetic recording heads. Each of these heads, each time it is excited for a brief instant by an electric current, generates a variable magnetic field, the effect of which is to create virtually point-shaped magnetized zones on the surface of the drum that travels past the recording device; taken together, these zones comprise a latent magnetic image corresponding to an image to be printed. These magnetized zones then travel past a developer applicator device 14 that is disposed below the drum 11 and makes it possible to apply particles of a powdered developer contained in a reservoir 15 to the cylindrical surface of the drum. The developer particles thus applied to the drum do not, in principle, adhere anywhere except to the magnetized zones of the drum and thus form a powdered image on the surface of the drum. A retouching device 16 past which the image then travels makes it possible to remove developer particles that have adhered anywhere but the magnetized zones of the drum, as well as any excess particles on these zones. It should be noted here that the developer thus deposited on the surface of the drum 11 comprises magnetic particles coated with a thermoplastic resin, which, as will be seen hereinafter, is capable of melting when exposed to a heat source and thus of being affixed to a sheet of paper onto which the developer has been transferred. The developer particles remaining on the drum 11 after having traveled past the retouching device 16 then travel past a charging device 17, the function of which is to positively charge the resin comprising the developer particles at the moment when these particles travel past it. After that, these particles are normally transferred in virtual totality onto a sheet of paper 18, which after having been drawn from the magazine 10 in a manner to be described below is applied to the surface of the drum 11 by means of a transfer cylinder 19.

This transfer cylinder 19 comprises a metal cylinder 20 that is coated on its cylindrical surface with a layer 21 of elastic material, made of a polyurethane rubber. The cylinder 20 is mounted in such a way that it can rotate about a horizontal shaft 22, which is positioned such that the elastic layer 21 of the cylinder 19 is constantly urged against the cylindrical surface of the drum 11. The region H where the transfer cylinder 19 thus comes into contact with the surface of the drum 11 comprises the transfer station.

In this station, the transfer of the powdered image that has been formed on the surface of the drum is effected onto a sheet of paper 18 which is grasped between the drum and the cylinder 19. The developer particles that are still located on the drum 11 when this transfer is performed are then lifted with a cleaning device 23. The magnetized zones that have traveled past the cleaning device 23 then travel past an erasing device 24, which makes it possible for the portions of the drum 11 that have thus been demagnetized by this device to be capable of being remagnetized when they travel past the recording device 13 once again.

Thus as can be seen from FIG. 1, the sheets of paper 18 that are successively grasped between the drum 11 and the transfer cylinder 19 for printing come from the magazine 10, in which they were stored beforehand. The extraction of the sheets from this magazine is performed by means of an extractor 25 of a known type including a roller 26 which is integral with a shaft rotating in a bearing fixed at one of the ends of a lever 27 mounted to pivot about a shaft 28, the other end of the lever being articulated on the end of a sliding rod 29 integrally connected with the movable armature of an electromagnet 30. The roller 28 is driven to rotate in the direction of the arrow G by a suitable driving device (not shown). Under these conditions, it will be understood that when the electromagnet 30 is temporarily excited, the lever 27 pivots and compels the roller 26 to penetrate to the interior of the magazine 10 and thus to come into contact with one of the sheets stored in the magazine. The roller 26 then compels the sheet to leave the magazine and to be grasped between drive cylinders 31. The sheet of paper that is fed by these cylinders 31 is guided in its displacement by guide plates (not shown), and it is finally grasped at the transfer station H between the drum 11 and the transfer cylinder 19. The developer particles that, having been deposited on the surface of the drum, come into contact with this sheet are then transferred in virtual totality to the sheet, the transfer being facilitated by the fact that since the drum 11 is electrically connected to the positive terminal (+) of a source of direct voltage and the cylinder 20 is connected to the negative terminal (−) of the same source, these particles, which have been positively charged by the charging device 17, are subjected to the action of an electrical field when they arrive in the transfer station and thus are urged to leave the drum 11 for the sheet of paper 18. The sheet 18, which is now locked between the drum 11 and the transfer cylinder 19, is thus driven by the rotation of the drum. However, after its passage through the transfer station, this sheet is detached from the drum surface by a separator device 32 and now being carried by a conveyor belt 33 then passes through a fixation device 34, which by heating causes the resin surrounding the magnetic developer particles that have been transferred to the sheet to melt, thus bringing about the permanent fixation of the developer.

After its passage through the fixation apparatus 34, the sheet, driven by the belt 33, passes through a cooling device 35 after being finally deposited in a receiving box 36.

In the printer shown in FIG. 1, the diameter of the drum 11 is such that the circumference of the drum is substantially equal to or slightly greater than the length of the sheets 18 to be printed. Under these conditions, the powdered image which is formed in the course of one rotation of the drum can be transferred integrally onto one of the sides of the same sheet, provided that the excitation of the electromagnet 30 that brings about the extraction of this sheet from the magazine 10 takes place at a precise instant t such that the leading edge of the sheet arrives at the transfer station H slightly before the leading edge of this powdered image arrives at the same station. Thus in forming a powdered image in the course of each rotation of the drum, it is possible by exciting the electromagnet 30 at the instant t, t+T, t+2T, t+3T, etc. (T representing the printer cycle, that is, the time taken by the drum 11 to execute one rotation), it is possible to transfer each of these images to only one of the sides of the sheets 18 that have been extracted from the magazine 10 at these instants. However, the printer that is shown in FIG. 1 is arranged in such a way as to transfer these powdered images onto both sides of the sheets that are drawn successively from the magazine 10. To this end, the electromagnet 30 is not excited at all the times t, t+T, t+2T, t+3T, etc., but only at times t+T, t+3T, t+5T, etc.

Since under these conditions no sheet of paper is grasped between the drum 11 and the transfer cylinder 19 for the entire time while the first powdered image formed on the drum travels past the transfer station H, this first powdered image is transferred in virtual totality to the outer surface of the elastic layer 21 of this transfer cylinder. This first powdered image, as will be seen below, is intended to be applied to the verso side of the sheet that will be drawn from the magazine 10 at instant t+T. It should also be noted that the magnetic drum 11 and the transfer cylinder 19 have the same diameter, so that this first powdered image, when it is transferred onto the cylinder, can be located entirely on the outer surface of the layer 21.

It should be noted again that the formation of the first powdered image on the drum in the course of the first cycle of the drum 11 is followed by the production of a second powdered image on the same drum, which takes place in the course of a second cycle of the drum. The second powdered image is intended for application onto the recto side of the sheet drawn from the magazine 10 at time t+T. During the formation of the second powdered image on the drum 11, the first powdered image, now located on the cylinder 19, is driven by rotation of the cylinder, and it moves past a cleaning brush 37 that is normally applied to the surface of the layer 21, but is spaced apart from this layer by known means (not shown) during the entire duration of the passage of the first powdered image past the brush. After that, this first image travels past a second charging device 38, the function of which is to cause the particles comprising the first image to lose the positive electrical charge that they had received from the charging device 17 and to make them now aquire a negative electrical charge. The position occupied by the first image on the layer 21 is such that the corresponding regions of this image and of the second powdered image approach the transfer station H at the same time. However, just before these two images come into contact with one another, the sheet of paper 18 that has been removed from the magazine 10 at time t+T is grasped between the drum 11 and the cylinder 19. Since the particles of the second powdered image have been positively charged by the device 17, and since the particles of the first powdered image have been negatively charged by the device 38, all of these particles, when they arrive at H, are subjected to the electrical field formed between the drum 11 and the cylinder 19, and under the influence of this field are compelled to pass virtually in totality to the sheet of paper 18, which is then printed simultaneously on both sides. Thus as indicated above, after having passed between the drum 11 and the cylinder 19, the sheet is engaged and driven by the belt 33 so that it passes through the fixation apparatus 34 before finally being deposited into the receiving box 36.

From the above explanation, it will be understood that the sheets of paper 18 that are drawn from the magazine 10 at times t+T, t+3T, t+5T, etc., and driven continuously by the cylinders 31 and the drum 11 succeed one another at intervals such that any two successive sheets are separated from one another by a distance M which is slightly greater than the length L of one sheet. It is assumed that in the example described each of these sheets has a length L of 297 mm and that the distance M separating two successive continuously driven sheets is equal to 331 mm.

As seen in FIG. 1, the fixation apparatus 34 includes a support 40 mounted to rotate on a horizontal shaft 41 coupled to the drive shaft of an electric motor 42. This electric motor 42, with two operating directions, is of a known type. Let it be assumed that the motor is of the type that is described as an accessory in the French Patent Application filed by the present applicant on Dec. 20, 1984 and published as No. 2.575.111 (corresponding to U.S. Pat. No. 4,657,416); this motor, of the alternating current type, includes two inductor coils wound in opposition, such that the motor rotates in one direction, when one of the coils is excited with alterating current, while the motor rotates in the opposite direction at the same speed when the other coil is excited.

Upon rotating, this motor 42 causes the support 40 to pivot about its shaft 41, the displacement of the support being limited by two stops comprising two electrical contacts 43 and 44. The support 40 normally occupies a position of repose $P_0$ (shown in dot-dash lines in FIG. 1), in which it keeps the contact 43 depressed; this position of repose is the position in which the support 40 is the farthest away from the transverse station H.

The support 40 can be displaced by the motor 42 in order to occupy a limit position $P_1$ in which it keeps the contact 44 depressed, this limit position being the one in which the support is closest to the transfer station H. It can also be seen from FIG. 1 that the transport belt 33 is an endless belt that can be driven for displacement in the direction indicated by the arrow by an electric motor 45. This belt, which is mounted on pulleys, travels in the course of its displacement over a guide plate 46, of cylindrical shape, the axis of curvature of which is located on the pivot shaft 41 of the support 40. The plate 46 extends at least over the entire portion of the path taken by the support 40 when the support is displaced between its positions $P_0$ and $P_1$.

The support 40 is provided with two sources of thermal radiation 47 and 48, disposed on either side of and spaced equally apart from the assembly comprising the plate 46 and the curved portion of the belt 33.

Thus when a sheet leaving the transfer station is grasped between this plate and the curved portion, the sheet, driven by the belt 33, passes between the two radiation sources 47 and 48. In actuality, the belt 33 is double, and comprises two belt elements that come into engagement with the side edges of this sheet. Similarly, the guide plate 46 comprises two plate elements, on which these two side edges of the sheet come to be applied. Under these conditions, the belt 33 and the plate 46 cannot stop the radiation, which originates in the sources 47 and 48 and is sent to the particles of the sheet onto which the two powdered images have been transferred.

Figure 2:
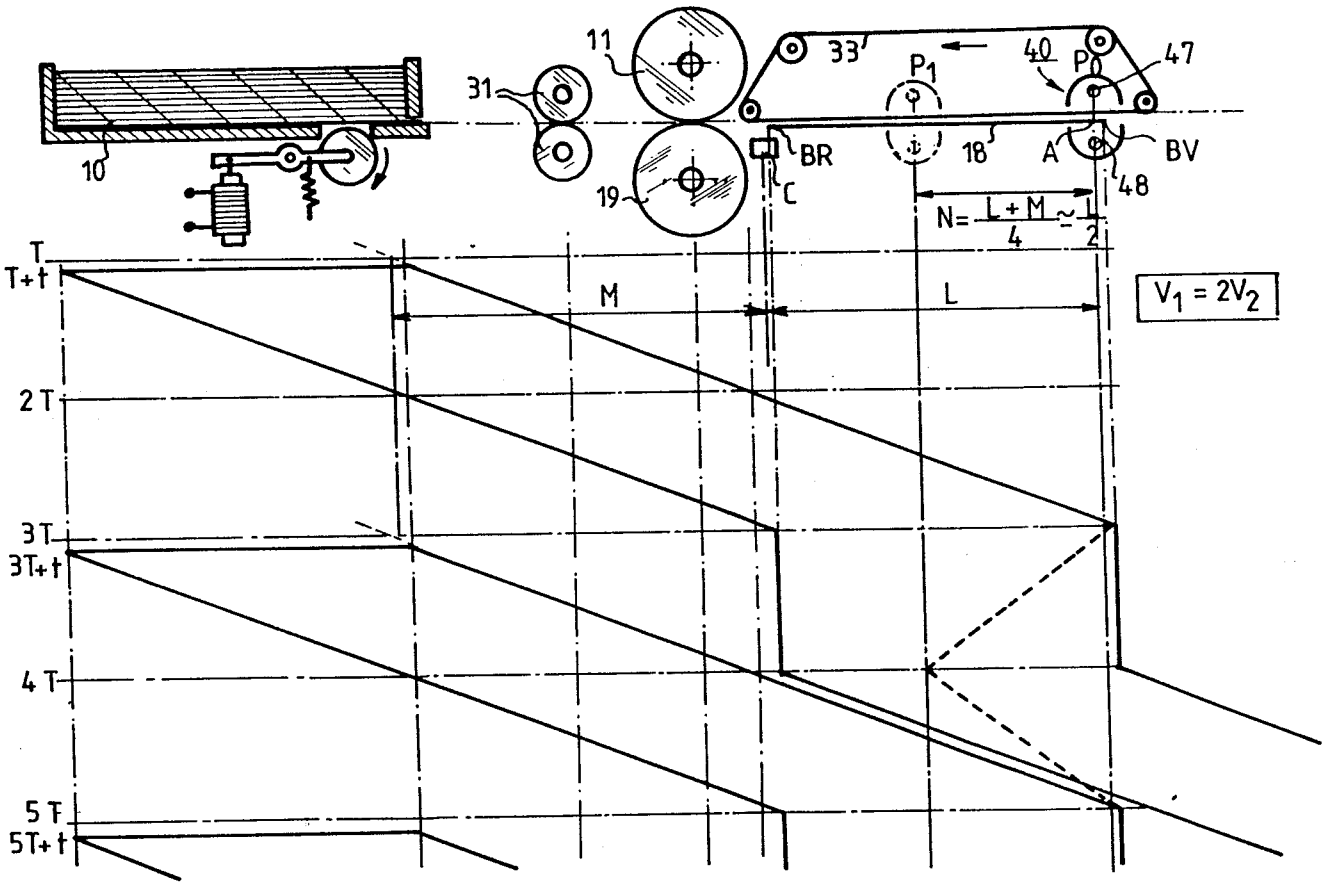
FIG. 2 is a diagram showing the relative linear displacements of the sheets and the radiation source in the printer shown in FIG. 1, in the case where the speed of displacement of the sheets is twice that of the radiation source.

The function of the fixation apparatus that has just been described will now be explained, referring to the diagram of FIG. 2, in which the movement of the sheets and of the support 40 have been shown in solid lines and broken lines respectively; in this drawing, the sheets and the support are assumed to be displaced along a rectilinear path, to make explanation easier. It is assumed that initially the support 40 is located in its position of repose $P_0$, and that the belt 33 is driven continuously by the motor 45. Referring to FIG. 2, it can be seen that the sheet of paper that is drawn from the magazine at t+T is displaced by the cylinders 31, the drum 11 and the belt 33 at a constant speed $V_1$ equal to:

$$\frac{L+M}{2T}$$

The value of t is such that the leading edge BV of this sheet arrives virtually at time 3T at a point A perpendicular to the sources 47 and 48 when the support 40 is located in its position of repose. A detector C is disposed along the path of this sheet, upstream of point A, with respect to the direction of displacement of the sheet, and at a distance from A equal to the length of the sheet.

This detector C is arranged to furnish an electrical pulse each time the trailing edge BR of a sheet driven by the belt 33 moves part it. This pulse, transmitted to the control circuit (not shown) of the motors 42 and 45, have the effect of deexciting the motor 45 and exciting the motor 42; the latter then causes the displacement of the support 40 to its limit position $P_1$. As a consequence of de-excitation of the motor 45, the belt 33 stops and no longer drives the sheet that is in contact with it. Meanwhile, as a consequence of the inertia of the mechanical parts of the printer and the lag of the electrical circuits, the edge BV of the sheet comes to a stop slightly downstream of point A, approximately 1 cm away from it.

The fixation apparatus that is shown in FIGS. 1 and 2 is arranged such that when the motor 42 is excited, the support 40 is displaced by the motor from its position $P_0$ to its position $P_1$, at a constant speed $V_2$ equal to one-half the speed $V_1$ at which the sheet that is now stopped was driven by the belt 33. The power of the radiation sources 47 and 48 is such that when these sources are displaced at this speed $V_2$ past the thus-stopped sheet, the radiation from these sources is sufficient to assure the fixation of the developer that has been transferred to the sheet, yet without causing excessive heating of the sheet. On the other hand, the electrical contact 44 is positioned in such a way that the displacement N undergone by the support 40 to travel from its position $P_0$ to its position $P_1$ is equal to:

$$\frac{L+M}{4}$$

Since the support 40 is driven by the motor 42 as soon as the trailing edge BR of the sheet of paper has passed the detector C, that is, at time 3T, it will be seen that the support 40 attains its limit position $P_1$ at time:

$$3T+\frac{L+M}{4}\cdot\frac{4T}{L+M}$$

that is, at time 4T. The support 40, arriving at this time at its position $P_1$, depresses the electrical contant 44, causing the excitation of the motor 45 and making the motor 42 rotate in the reverse direction. Under these conditions, the support 40 returns to its position of repose $P_0$ at the same speed $V_2$ as that with which it was displaced to move toward its position $P_1$, so that the support 40 reaches its position of repose at time 5T. At this time, the support 40 depresses the electrical contact 43, causing the de-excitation of the motor 42 and consequently the immobilization of the support 40 in its position of repose, until this support is again driven by the travel past the detector C of the trailing edge of the following sheet of paper. Moreover, upon the return of the support 40 to its position of repose, the motor 45, which is excited again, drives the sheet that was immobilized in the fixation device between times 3T and 4T, this sheet then being displaced at the speed $V_1$ so that it passes beneath the cooling device 35 and is finally ejected into the receiving box 36. During the return motion of the support 40 to its position of repose $P_0$, this sheet is thus moved with respect to the support 40 at a relative speed equal to $V_1-V_2$, or in other words, since $V_1=2V_2$, at a relative speed equal to $V_2$.

It can now be observed that in the example described, where each of the sheets of paper has a length L of 297 mm and the distance M separating any two successive sheets assumed to be driven continuously is equal to 331 mm, the displacement N undergone by the support 40 to travel from one of its positions to the other is equal to:

$$N=\frac{297+331}{4}$$

that is, is equal to 157 mm. Thus in the example described, the value of this displacement is quite close to that of one-half the length of the sheet.

From the above explanation, it can be seen that the fixation of the powdered images deposited onto a sheet of paper takes place by a method which comprises first bringing the sheet to the fixation apparatus, such that the leading edge of the sheet is immobilized virtually facing thermal radiation sources 47 and 48, these sources being temporarily immobilized in a position of repose $P_0$, then displacing the sources past the sheet, at a first constant speed $V_2$, in the direction of the trailing edge of the sheet, but over a length N less than the length of the sheet, then moving these sources to the position of repose and simultaneously displacing this sheet in the same direction as the sources, at a constant speed $V_1$ greater than the first speed $V_2$, the return of the sources to the position of repose taking place at a speed the value of which is numerically equal to the difference $V-V_2$. In the example described, where the displacement speed of the sheet is twice that of the sources, the length N of the path taken by these sources to move from one position to the other is virtually equal to one-half the length of the sheet, and the return of the sources to the position of repose is accomplished at the same speed as the motion from the position of repose, that is, at the speed $V_2$.

In a more general mode of performing the method according to the invention, the speed $V_1$ of displacement of the sheets certainly does not have to be equal to twice the speed $V_2$ at which the sources are displaced to move from their position of repose $P_0$ to their limit position $P_1$. In the general case where the speed $V_1$ of displacement of the sheets is equal to $$V_1=kV_2,$$

k being a positive given number greater than 1, this limit position $P_1$ is located at a distance N from the position of repose such that the following applies:

$$N=\frac{k-1}{K}L.$$

Under these conditions, beginning at the time when the detector C detects the passage of the trailing edge of a sheet grasped in the fixation apparatus, the sources 47 and 48 are displaced at the speed $V_2$ from their position of repose $P_0$ to this position $P_1$, and the time taken by the sources to perform this displacement is equal to:

$$t_1=\frac{N}{V_2}=\frac{k-1}{k}\cdot\frac{L}{V_2}$$

Upon their return to the position of repose, the speed at which the sources are driven is equal to:

$$V'_2=V_1-V_2=V_2(k-1)$$

such that the time taken by these sources to return to the position of repose is equal to:

$$t_2=\frac{N}{V'_2}=\frac{k-1}{k}\cdot\frac{L}{(k-1)V_2},$$

or in other words, $$t_2=\frac{L}{kV_2}.$$

Thus the time necessary for the fixation of the powdered images formed on a sheet is equal to:

$$\theta=t_1+t_2=\frac{(k-1)L+L}{kV_2}=\frac{L}{V_2}$$

Since L and $V_2$ are constant, it can be seen that the fixation time is constant; that is, the fixation time is independent of the displacement speed of the sheets. The method of the present invention makes it definitively possible to obtain excellent fixation of powdered images on the sheets of paper, regardless of the speed at which the sheets are driven. This method is still more advantageous, because the fixation apparatus it required is reduced in bulk and includes a moderate-power heating element. In effect, in the case where a heating element of the same power as that with which the apparatus of the invention is equipped is used for fixation of powdered images formed on the sheets fed continuously at the speed $kV_2$, but where the heating element is fixed, these sheets will have to be subjected to the action of this heating element for the time period as follows:

$$\theta=\frac{L}{V_2}$$

so that this element would have to have a length L such that:

$$R=k\,V_2\cdot\theta=kV_2\cdot\frac{L}{V_2},\text{ that is, } R=kL.$$

Hence it is seen that this length is notably greater than that needed by the apparatus of the invention for displacement of the radiation sources, which is:

$$N=\frac{k-1}{K}L.$$

Figure 3:
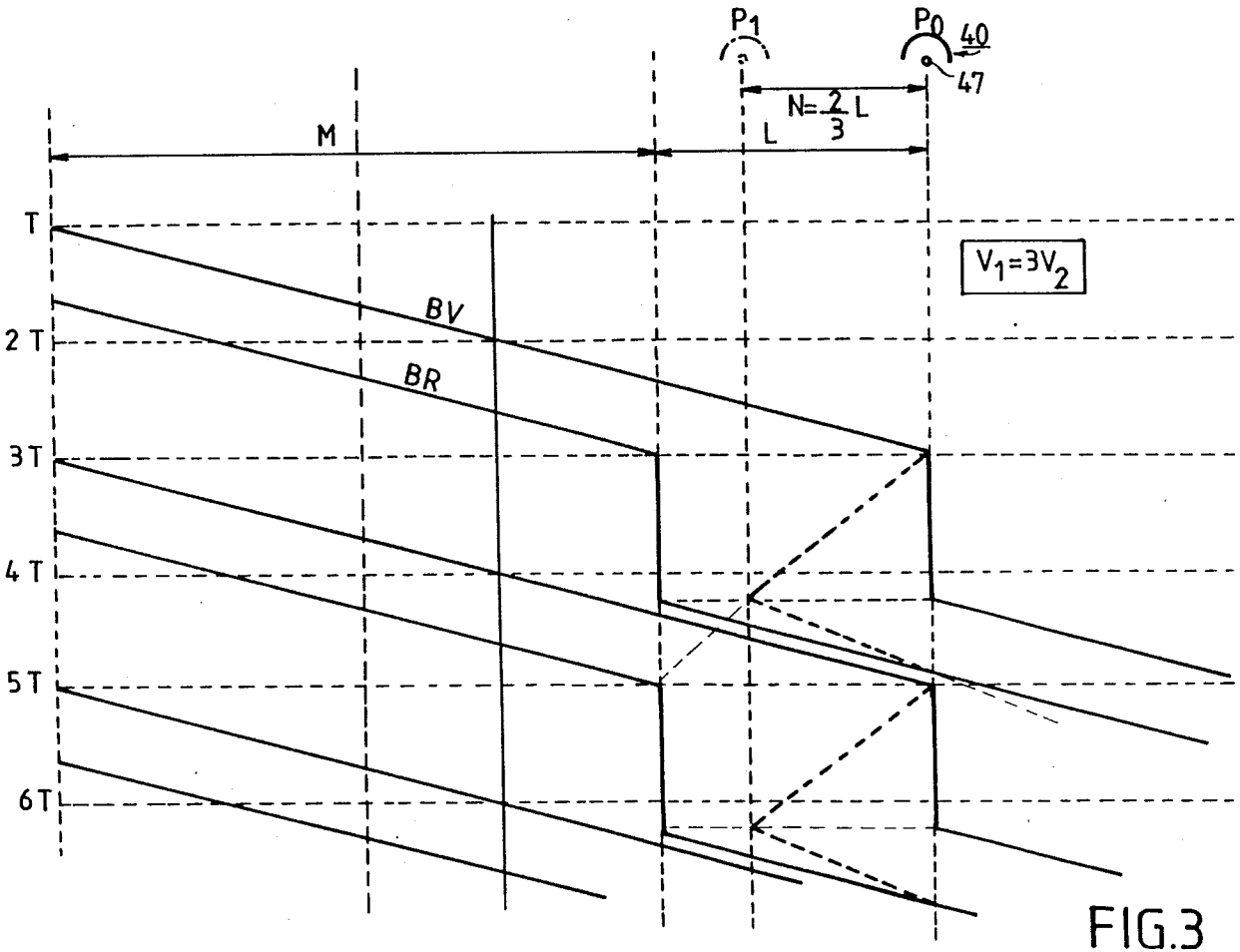
FIG. 3 is a diagram showing the relative linear displacements of the sheets and the radiation source in a first mode of performing the method and in the case where the speed of displacement of the sheets is triple that of the radiation source.

By way of example, FIG. 3 is a diagram showing the relative linear displacement of the sheets and of the support 40 in the case where the speed of sheet displacement $V_1$ is triple that $V_2$ at which the support is displaced to move from its position of repose $P_0$ to its limit position $P_1$. For the sake of simplification, the sheet supply magazine and the devices for driving the sheets drawn from this magazine have not been shown in this drawing figure. For the same reason, it has been assumed in this drawing figure that the position of repose $P_0$ of the support 40 is located precisely perpendicular to the leading edge BV of the sheets that come to be immobilized in the fixation apparatus at times 3T, 5T, 7T, etc. Accordingly, FIG. 3 shows that the sheet the leading edge of which arrives perpendicular to this position $P_0$ at time 3T is initially immobilized in the fixation apparatus and that in the course of this immobilization, the support 40 is displaced from its position $P_0$ to its position $P_1$ at the constant speed $V_2$. This speed $V_2$, which is the speed at which the support 40 is normally displaced when the sheet is immobilized to bring about the fixation of the developer on the sheet without producing deleterious excess heating of the sheet, is very slightly greater than L/2T. The displacement of the support 40 past the thus-immobilized sheet is performed over a length N=2/3L and for a time t1 equal to 2/3 $L/V_2$, that is, substantially equal to 4/3 T. At the instant at which the support 40 attains its limit position $P_1$, this sheet is again driven with displacement at the speed $V_1=3V_2$, while the support 40 is moved to its position of repose $P_0$ at the speed $V'_2=2V_2$, this return being performed during a time period equal to t2, which equals:

$$\frac{L}{3V_2},$$

that is, substantially equal to 2T/3. Thus the return of the support 40 to the position of repose takes place at a speed $V'_2$ which is greater than the speed $V_2$.

By definition, the method of the invention is characterized in that it comprises first moving each sheet such that the leading edge BV of the sheet is located facing the radiation source 47 or 48, which is temporarily immobilized in the position of repose $P_0$, and then implementing two successive phases, one of which (for example, the first) comprises keeping this sheet immobile and displacing the source past the sheet at the constant speed $V_2$, over a length N less than the length L of the sheet, and the other phase (in this case the second phase) comprises displacing the source in the reverse direction and simultaneously displacing the sheet in the same direction as the source, at the speed $V_1$ greater than $V_2$, the movement of the source in the course of this other phase taking place at the speed $V'_2=V_1-V_2$.

Figure 4:
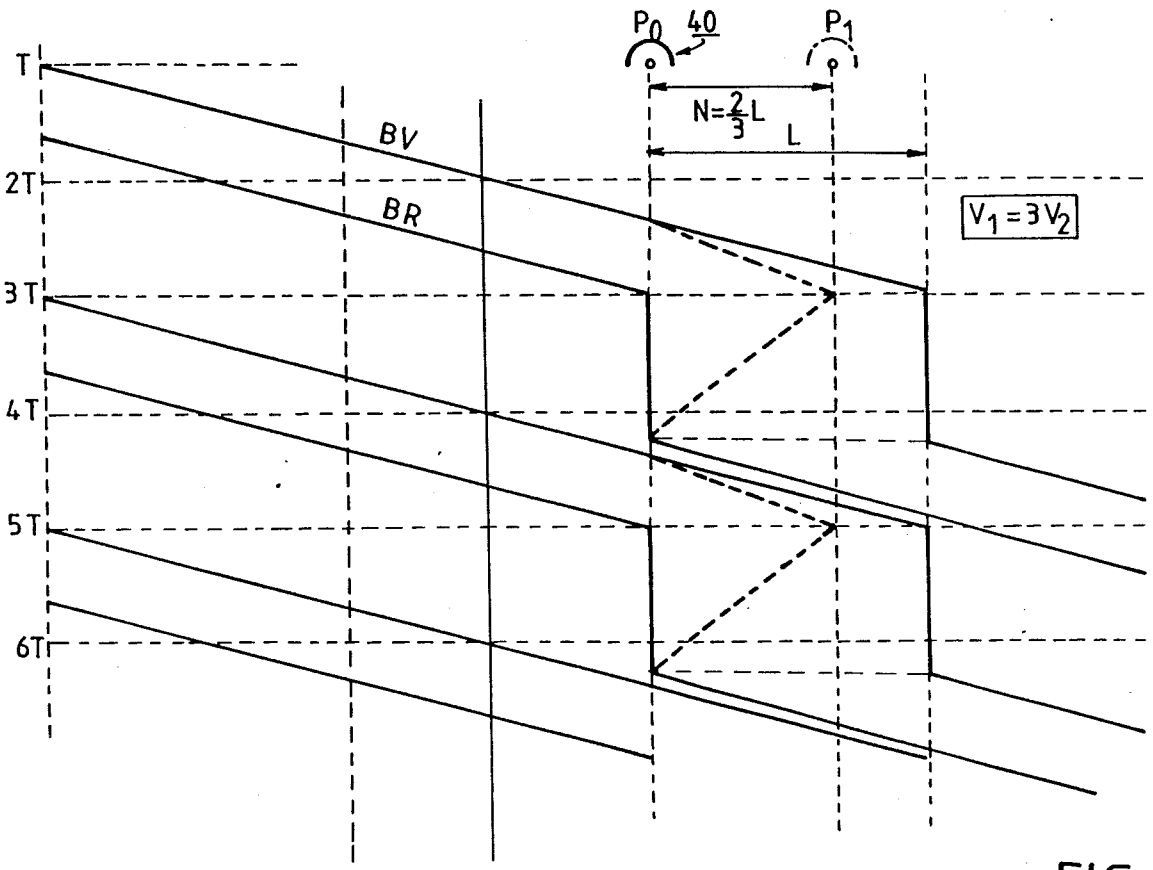
FIG. 4 is a diagram showing the relative linear displacements of the sheets and the radiation source in a second mode of performing the method and in the case where the speed of displacement of the sheets is triple that of the radiation source.

The order in which these two phases are implemented may also be reversed. In that case, the limit positions $P_0$ and $P_1$ of the radiation source are likewise reversed. An example of this kind of procedure is illustrated by FIG. 4, in which it can be seen that beginning at the time when the leading edge BV of a sheet arrives perpendicular to the radiation source temporarily immobilized in its position of repose $P_0$, this source is driven in the same direction as the sheet at the speed $V'_2=V_1-V_2$, while the sheet continues its movement at the speed $V_1$. This first phase terminates when the trailing edge BR of the sheet arrives facing the position $P_0$, that is, when the source has traveled the distance N mentioned above. Beginning at that instant, the second phase is implemented, comprising keeping the sheet immobile and displacing the source past the sheet in the reverse direction of the displacement performed in the first phase and at the constant speed $V_2$.

What is claimed is:

1. A method for fixing a powder developer image formed on at least one of the sides of a sheet (18), said sheet being transported along a sheet transport path provided with a movable radiation source (47) temporarily immobilized in a position of repose (Po), said sheet being moved along said path in a predetermined direction and at a constant speed ($V_1$) so that said sheet has a leading edge (BV) and a trailing edge (BR), said method comprising:

first stopping said sheet when its leading edge (BV) arrives in front of said radiation source (47) in said position of repose (Po), and displacing said source past said stopped sheet, in a direction opposite to said predetermined direction, at a constant speed ($V_2$) equal to $V_1/k$ and over a length (N) given by the following relation:

$$N - \frac{k-1}{k} L$$

where k is a positive given number greater than 1 and L is the distance that separates said leading edge (BV) from said trailing edge (BR), then displacing said sheet in said predetermined direction, at said aforementioned sheet constant speed ($V_1$), and simultaneously displacing said source (47) in the same direction as said sheet, at a constant speed ($V'_2$) equal to:

$$V_1 \frac{(k-1)}{k}$$

until said source reaches its position of repose (Po).

2. A method for fixing a powder developer image formed on at least one of the sides of a sheet (18), said sheet being transported along a sheet transport path provided with a movable radiation source (47) temporarily immobilized in a position of repose (Po), said sheet being moved along said path in a predetermined direction and at a constant speed ($V_1$) so that said sheet has a leading edge (BV) and a trailing edge (BR), said method comprising:

first displacing said radiation source (47) when said leading edge (BV) arrives in front of said position of repose (Po), in the same direction as said sheet and at a constant speed ($V'_2$) equal to:

$$V_1 \frac{(k-1)}{k}$$

where k is a positive given number greater than 1, then stopping said sheet as soon as said radiation source (47) has been displaced over a length (N) given by the following relation:

$$N - \frac{k-1}{k} L$$

where L is the distance that separates said leading edge (BV) from said trailing edge (BR), and displacing said source (47) towards its position of repose (Po), from the instant where said sheet has been stopped, at a constant speed ($V_2$) equal to $V_1/k$.

3. A method as defined by claim 2, characterized in that the displacement of the radiation source, beginning at its position of repose, is effected over a length virtually equal to one-half the distance separating said leading edge from said trailing edge.

4. A method as defined by claim 1, characterized in that the displacement of the radiation source, beginning at its position of repose, is effected over a length virtually equal to one-half the distance separating said leading edge from said trailing edge.

* * * * *